United States Patent [19]

Pai

[11] Patent Number: 5,058,706

[45] Date of Patent: Oct. 22, 1991

[54] SAFETY CONTROLLER FOR HIGH-BUILDING ESCAPEE

[76] Inventor: Yang-Kwan Pai, 2Fl, No. 15, Lane 509, Sec. 3, Ho Peing E. Rd., Taipei, Taiwan

[21] Appl. No.: 461,615

[22] Filed: Jan. 8, 1990

[51] Int. Cl.[5] ..... A62B 1/14

[52] U.S. Cl. ..... 182/5; 188/65.5

[58] Field of Search ..... 182/5, 6, 7, 235; 188/65.5

[56] References Cited

U.S. PATENT DOCUMENTS

| | | | |
|---|---|---|---|
| 702,858 | 6/1902 | Hendricks | 182/6 |
| 3,826,341 | 7/1974 | Ledner | 182/5 |
| 4,494,629 | 1/1985 | Raeburn | 188/65.5 |
| 4,645,034 | 2/1987 | Griffith | 182/5 |
| 4,650,033 | 3/1987 | Aurness | 182/7 |
| 4,662,475 | 5/1987 | Rutschi | 182/5 |

*Primary Examiner*—Reinaldo P. Machado
*Attorney, Agent, or Firm*—Erik M. Arnhem

[57] ABSTRACT

It is an escaping device from a high building, whereby an escapee can descend slowly along a rope from a high building; an escapee merely holds the grips of the device to push up or down so as to have the clamping blocks turned so as to clamp or release the rope; then, the device can move downwards quickly or slowly, or stop so as to let an escapee hooked on the device descend to the ground safely.

3 Claims, 7 Drawing Sheets

20
21

21
20
10

13
25
3
24
18
16
17
14
21
6
15
3
19
25
3
19
16
17
18
24
14
15
3
13
6

20
21

21
10
20

25
13
3
24
14
18
16
17
21
15
3
19
6

25
13
3
24
14
17
18
16
15
3
19
6

SAFETY CONTROLLER FOR HIGH-BUILDING ESCAPEE

BACKGROUND OF THE INTENTION

In the present industrial society, many high buildings have been constructed. In case of a fire taking place in the high building, people in a building would usually have difficulty in escaping down an extension type ladder because the height of the ladder is limited. As result, some of the escapees would jump from the building to cause injuries or casualties. Some buildings have been provided with rope type escape devices wherein rope clamp devices are attached to a person to control the rate of descent along the rope. Most of the conventional escape devices comprises mainly two clamping blocks to hold a rope therebetween; when the grips on the blocks are pushed up or down, the two clamping blocks would clamp or release the rope. Such a clamping device has the drawback of causing the rope to slide, and the space between the two clamping blocks usually does not adapt to the diameters of some ropes; therefore, the aforesaid drawbacks in operation should be eliminated as much as possible.

SUMMARY OF THE INVENTION

This invention relates to a safety controlling device for high-building escapee, and particularly to a clamp device which can slide downwards along a rope to convey an escapee from a high building to the ground. The device mainly comprises clamping blocks having round holes respectively to let a rope pass through. Each of the clamping blocks is mounted with a grip so as to let an escapee push the grip up or down for turning the blocks to release or clutch a rope to stop the device to move downwards. When the round holes of the two blocks are in alignment and in parallel with, the rope, the controller can move downwards quickly; when the round holes are transverse to the rope path the controller moves more slowly. The person's belt can be hooked with a hook on the controller to enable the person to descend along the rope to the ground safely.

Another feature of the present invention is to provide a controller, in which the grips thereof can be pushed up or down to control the descending speed of the controller, or to stop it for a while.

A further feature of the present invention is to provide a controller, in which there are several braking point to clutch a rope by bending the rope at an angle of 90° so as to have the controller moved downwards slowly; in that case, an escapee would not fall too quick to endanger his (or her) safety.

BRIEF DESCRIPTION OF THE DRAWINGS

FIG. 6-1 is a front view of the inner structure of embodiment-2 according to the present invention (showing a closely catching state between the clamping blocks and the rope).

FIG. 6-2 and FIG. 6-3 are front view and perspective view of the actuating bar.

FIG. 7-1 is a front view of the inner structure of embodiment-2 according to the present invention (showing a loose state between the clamping blocks and the rope.

FIG. 7-2 and FIG. 7-3 are front view and perspective view of the actuating bar.

DETAILED DESCRIPTION

Figure 1:
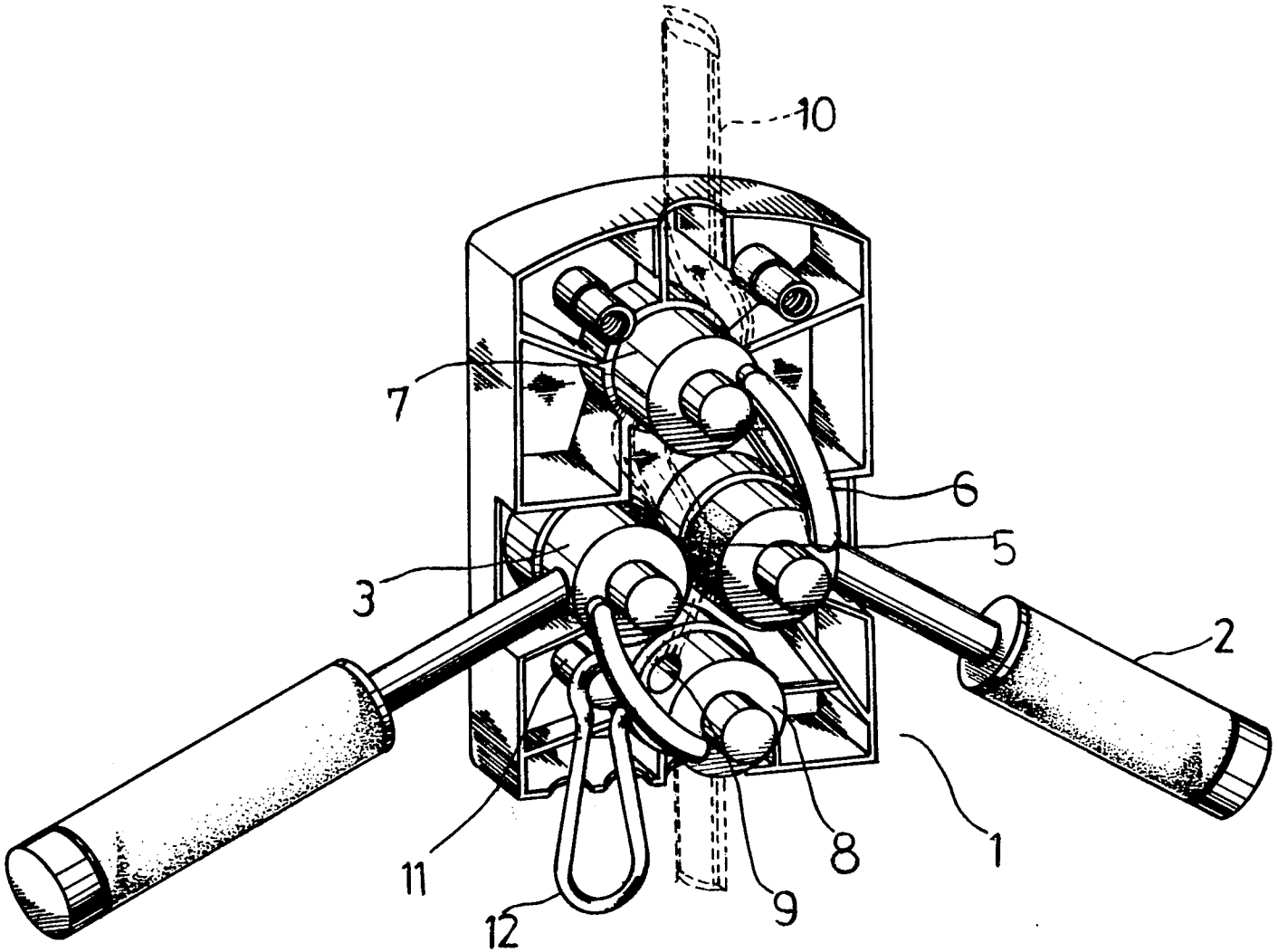
FIG. 1 is a perspective view of the present invention, showing the inner structure thereof.
Figure 2:
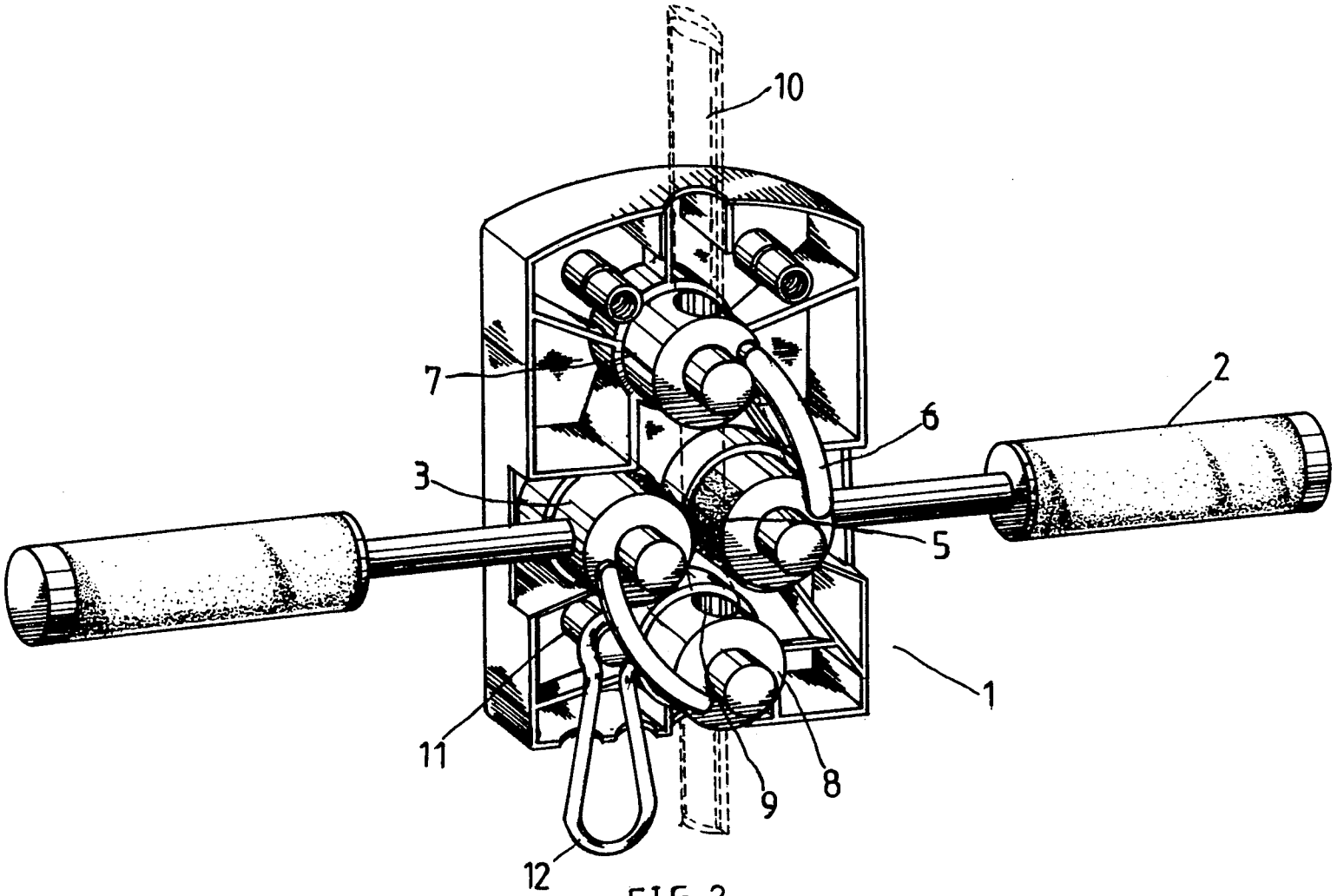
FIG. 2 is a perspective view of the present invention, showing a loose state between the clamping blocks and the rope.
Figure 3:
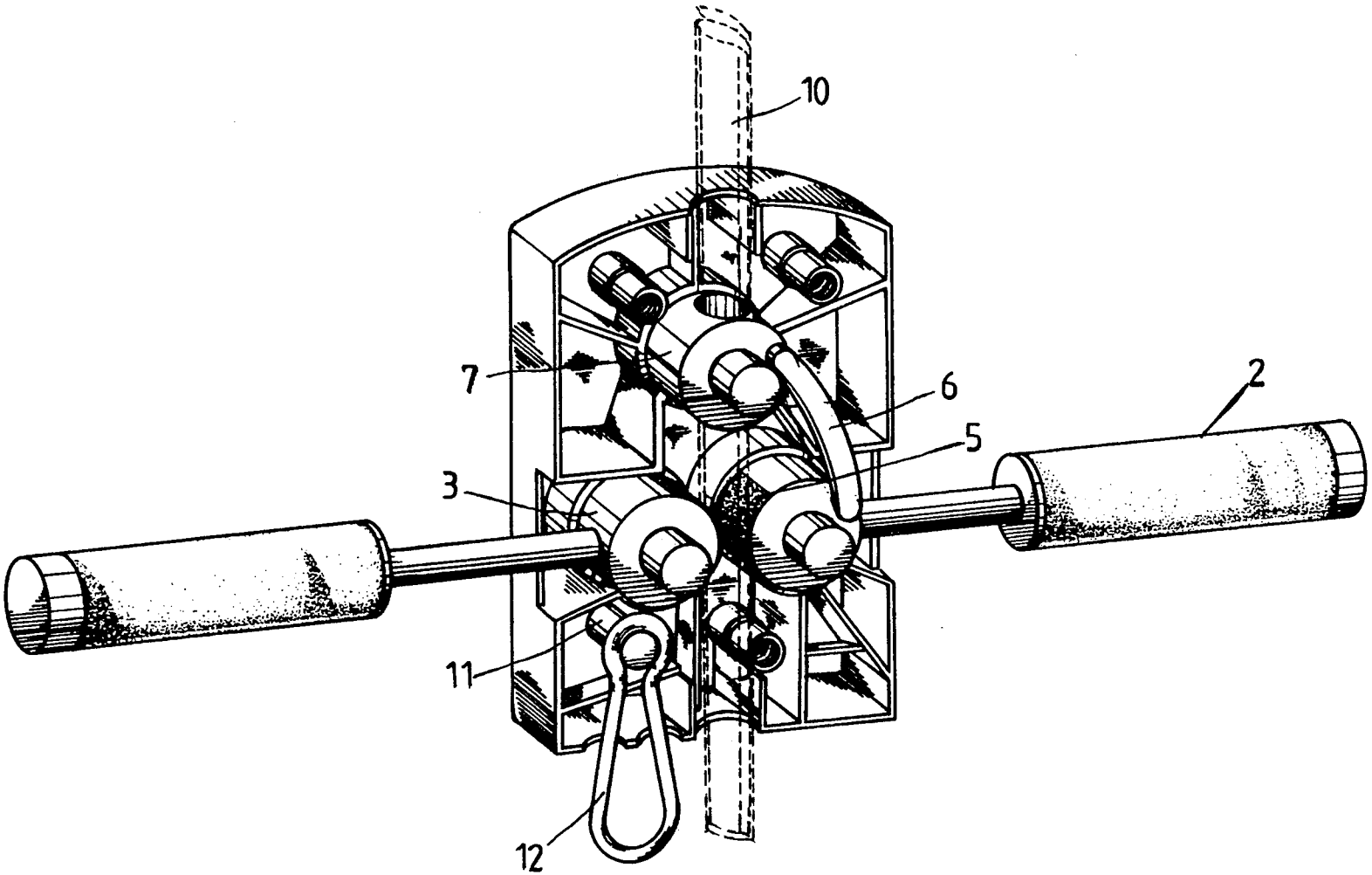
FIG. 3 is a perspective view of embodiment-1 according to the present invention, showing a loose state between the clamping blocks and the rope.
Figure 4:
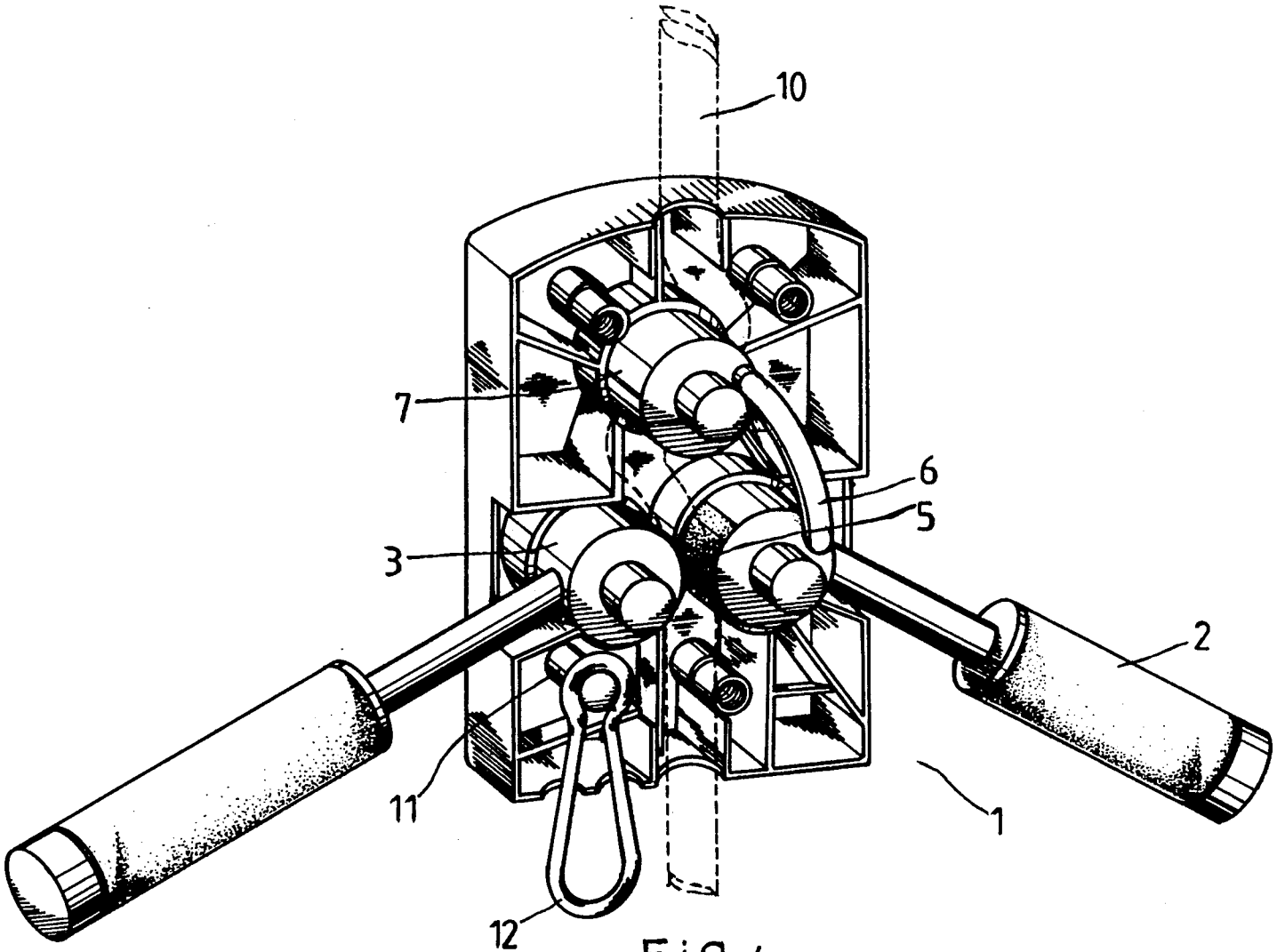
FIG. 4 is a perspective view of embodiment-1 according to the present invention, showing a closely catching state between the clamping blocks and the rope.

Referring to FIG. 1, there shows a perspective view of the inner structure of the present invention, in which both sides of the speed controller 1 are mounted with two speed-adjusting grips 2 respectively. The front end of each grip 2 is connected with a rotary clamping block 3. One side of the clamping block 3 is furnished with a braking strip 5. The rotary upper side of the clamping block 3 is mounted with a bent connecting rod 6, whereby the upper and lower pivotable clamping blocks 7 and 8 are connected and coupled with the clamping block 3 for movement. Blocks 7 and 8 are located on a central vertical axis of the controller housing in alignment with rope openings in the housing top and bottom walls. Both the upper clamping block 7 and the lower clamping block 8 are furnished with two aligned-through-round holes 9 so as to facilitate a rope to pass therethrough. Clamping blocks 3 are spaced equidistant from the central vertical axis of the controller housing with their rotation axis located on a transverse horizontal axis of the housing. The facing surfaces of blocks 3 are spaced apart to define a central rope grip zone. The lower part of the controller 1 has fixed pin 11 with a hook 12 extended out of the controller so as to hook an escapee there on. FIG. 2 illustrates the clamping blocks and the rope being set in a loose state, i.e., the rope 10 and the round hole 9 being in parallel, and the two clamping blocks 3 not clamping the rope 10; in that case, an escapee can slide downwards. Referring to FIGS. 3 and 4, there shows only one connecting rod 6 being connected between the upper clamping block 7 and the clamping block 3.

Figure 5:
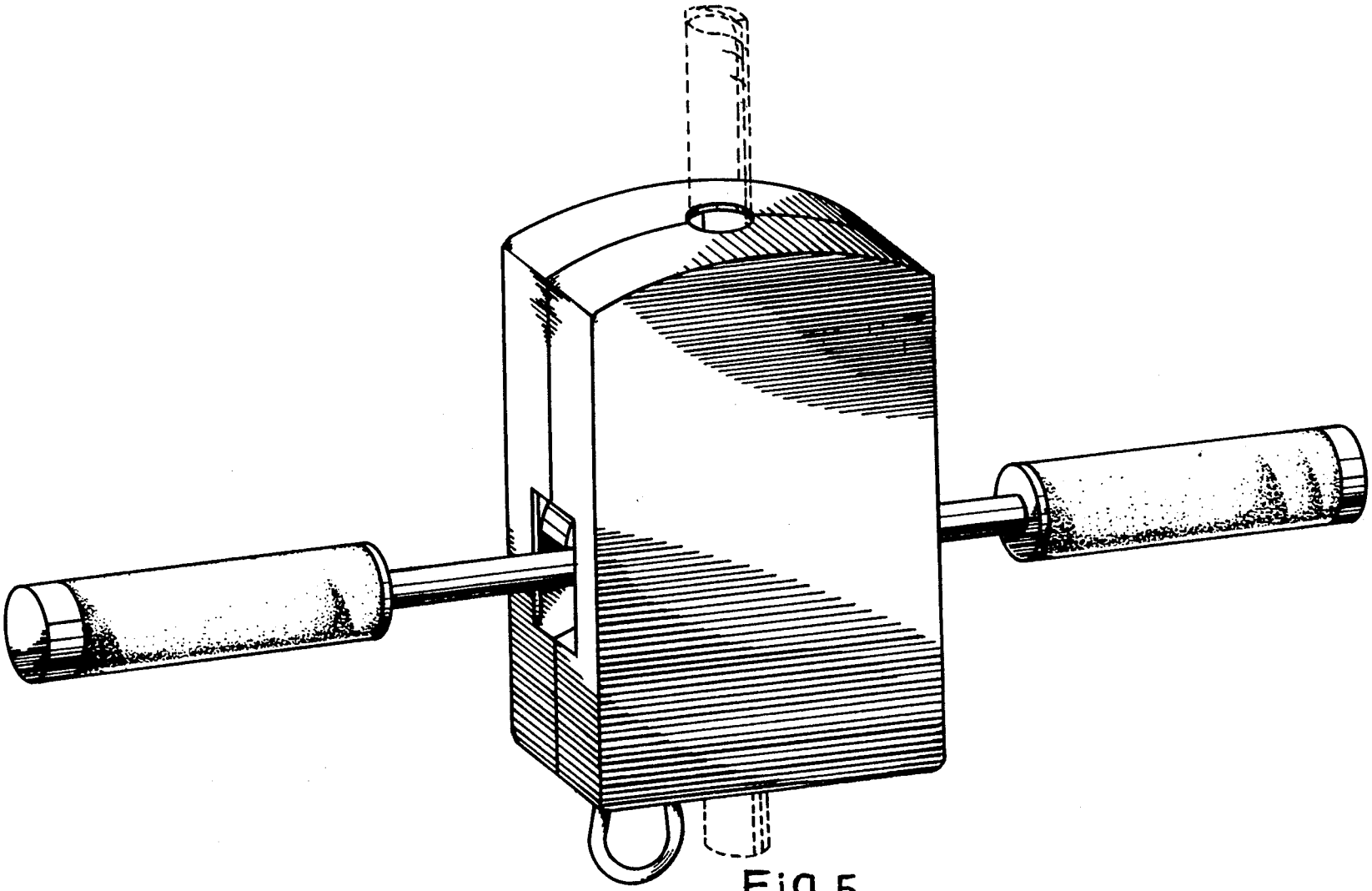
FIG. 5 is an outer perspective view of the present invention.

FIG. 5 is an outer perspective view of the present invention. In case of using the present invention, the escapee should tie one end of the rope 10 to a strong post or the like, and have the other end of the rope passed through the speed controller 1 and thrown outside of the high building; then, the hook 12 is hooked on the escapee's body. The rope 10 has to pass through the round hole 9 and the space between the two clamping blocks 3; the escapee should hold the grips 2, and then the escapee's body weight would cause the braking strips of the clamping blocks 3 to engage with the rope 10. Simultaneously, the upper and lower clamping blocks 7 and 8 will rotate, as a result of the connecting rods 6, to bend the rope 10 to be stopped to move; When hand grips 2 are in the FIG. 1 positions holes 9 in blocks 7 and 8 extend generally transverse to the vertical axis through each block 9 to exert a retarding force on the rope. The escapee can descend slowly by pushing the grips 2 upwards so as to let the braking strips 5 of the two clamping blocks 3 release the rope 10; in that case, the round holes 9 of the upper and lower clamping blocks 7 and 8 become parallel with the rope 10, and the escapee can comfortably and safely move downwards at a controlled speed. Since the upper and lower clamping blocks 7 and 8, and the braking strips 5 can provide a double safety to the escapee.

Figures 1, 2, 3, 6:
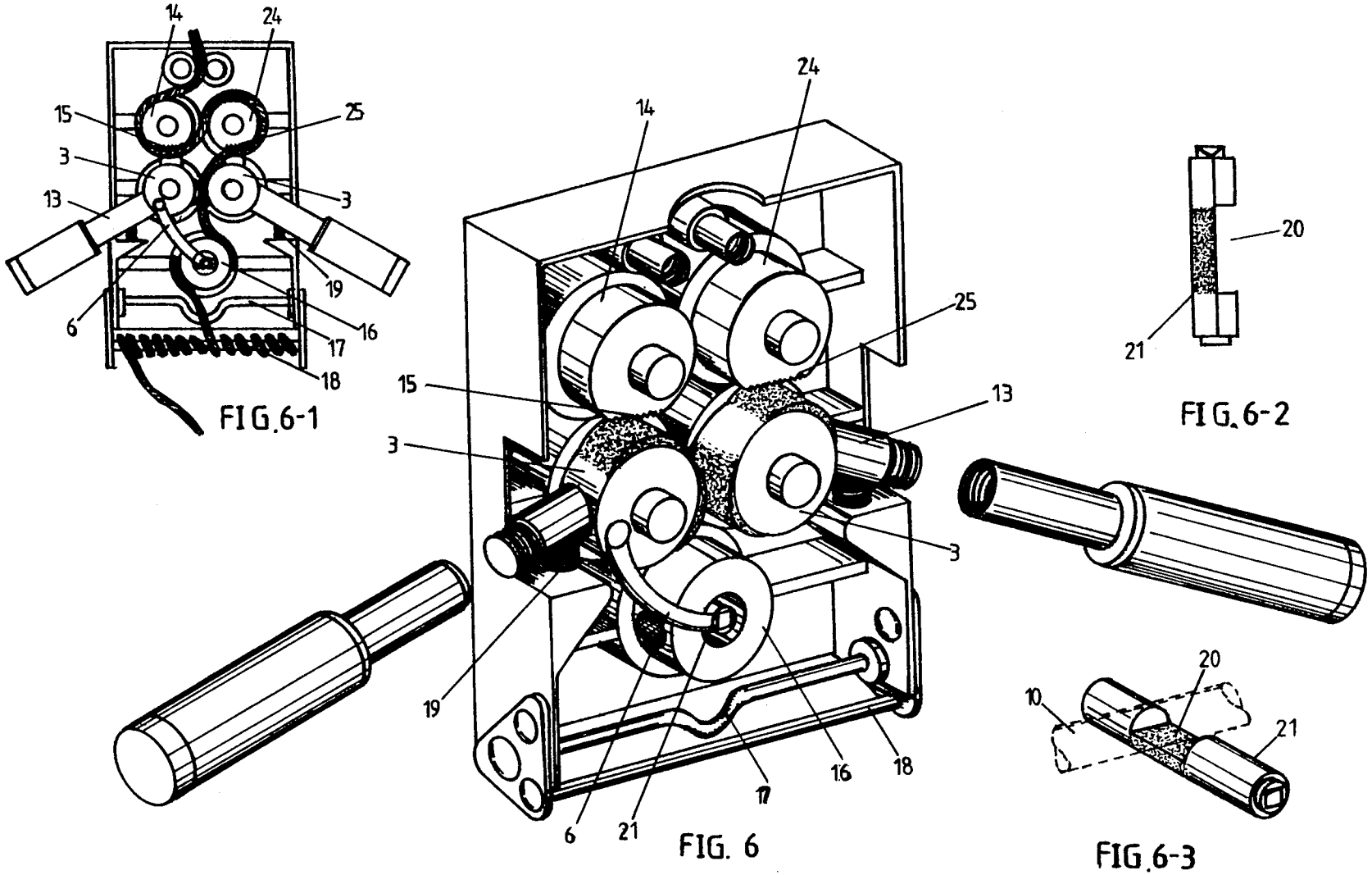
FIG. 6 is a perspective view of embodiment-2 according to the present invention, showing the inner structure thereof.
Figures 1, 2, 3, 7:
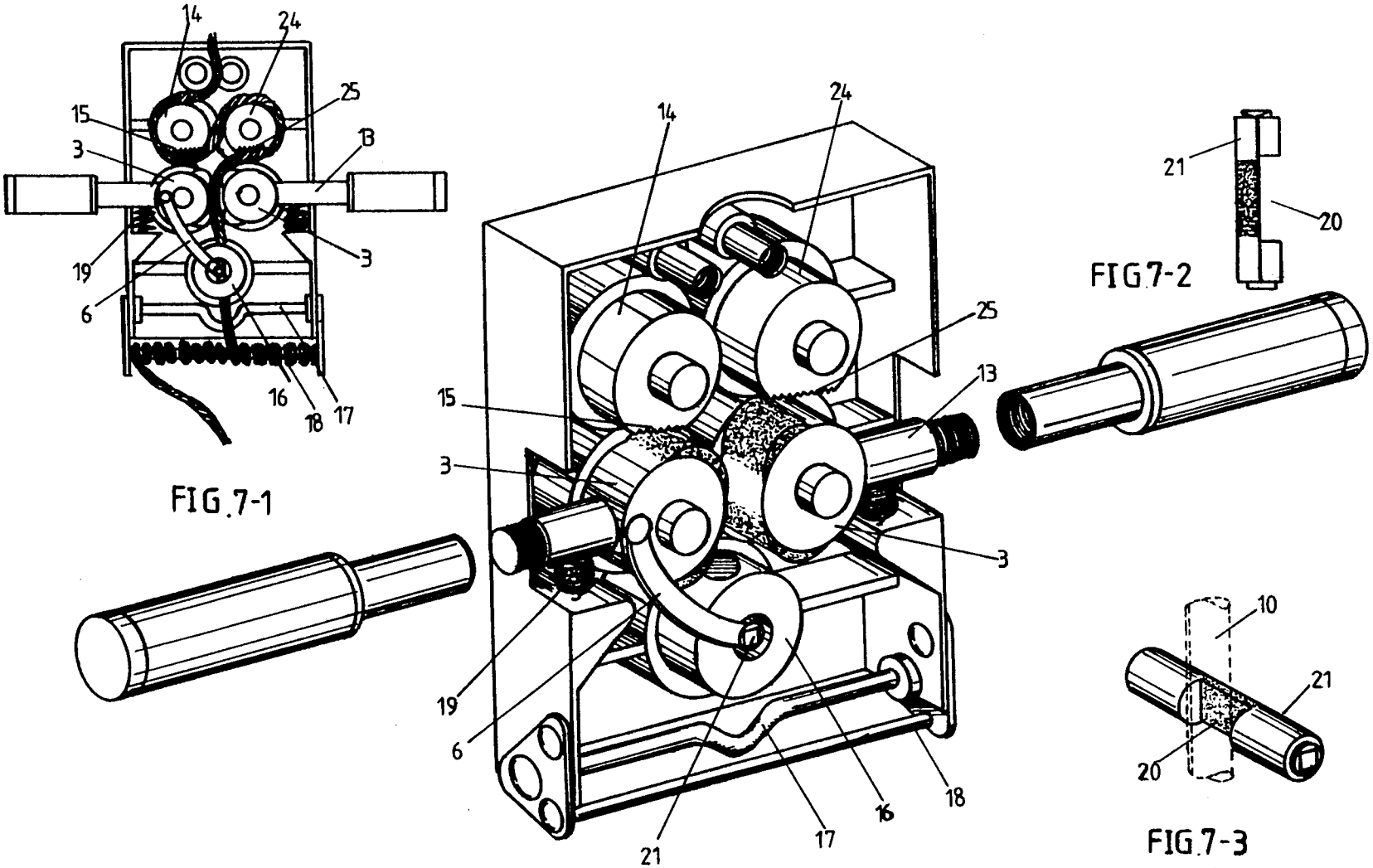
FIG. 7 is a perspective view of embodiment-2 according to the present invention, showing the inner structure thereof.

FIGS. 6 and 7 illustrate embodiment-2 according to the present invention, in which the grips 2 can be connected with the grip rods 13 respectively by means of threads thereon. When not in use, the grips 2 may be unscrewed and removed so as to facilitate the controller 1 to be put in a box. Each of the grip rods 13 is provided with a spring 19 thereunder so as to have the grip 2 returned to its original position after each pushing operation. The lower sides of the fixed clamping blocks 14 and 24 are furnished with zigzag surfaces 15 and 25 to increase the friction clutch to the rope. There is a movable clamping block 16 being installed under the clamping blocks 3, which is connected with a clamping block 3 by means of a bent connecting rod 6. The center of the movable clamping block 16 has a round recess, in which an actuating bar 21 is installed to be connected with one end of the bent connecting rod 6, and whenever the connecting rod 6 is moved, the actuating bar 21 will be turned at an angle of 90°. The central part of the actuating bar has an elongate groove 20 to let the rope 10 pass through (as shown in FIGS. 6-2, 7-2, 6-3 and 7-3). The lower end of the controller 1 is installed with a hanging bar 17, on which an escapee hook is to be hooked up. Under the hanging bar 17, there is rope shaft 18 for winding the rope thereon.

Referring to FIGS. 6-1 and 7-1, there shows the speed controller in descending state and in friction-clutch state respectively. After the grips 2 being pushed downwards, the clamping blocks 3 will be rotated, and simultaneously the actuating bar 21 in the movable clamping block 16 will also be turned at an angle of 90° as a result of the connecting rod 6; then, the rope that is put through the movable clamping block 16 will be bent to a friction-clutch state; the speed controller 1 is in stop condition. As soon as the grips 2 are released and lifted up by the spring, the clamping blocks 3 and the actuating bar 21 of the movable clamping block 16 actuated by the connecting rod 6 will turn reversely at an angle of 90°, and then the rope 10 is released from actuating bar 21 of the clamping blocks (becoming loose). The speed controller 2 will descend again. The lower sides of the fixed clamping blocks 14 and 24 are furnished with zigzag surfaces 15 and 25 respectively, which are opposite to the braking strips 5 on the clamping block 3 respectively so as to clutch the rope 10, and to let the controller move slowly to provide the user with an absolute safety.

I claim:

1. A safety controller for enabling a person to escape from a high building by descending downwardly along a suspended rope; said controller comprising a housing attachable to the person, said housing having an upper rope passage opening and a lower rope passage opening, said openings being vertically aligned to form a central vertical axis through the housing; two rotary clamping blocks (3) mounted within said housing equidistant from said central vertical axis on opposite sides thereof; said rotary clamping blocks having their respective rotation axes located on a transverse horizontal axis of the housing so that the facing surface of the blocks spaced apart to define a central rope grip zone; elongated hand grips (2) extending from respective ones of said clamping blocks in opposite directions away from the central rope grip zone; each hand grip having a first position extending generally horizontally from the associated clamping block along the aforementioned transverse axis, and a second position angling outwardly and downwardly away from the central rope grip zone; at least a third clamping block pivotably mounted within the housing with its pivot axis located on the central vertical axis of the housing; a connector means (6) interconnecting one of the rotary clamping blocks to the pivotable clamping block so that rotation of said one rotary clamping block by the associated hand grip produces a pivotal motion of the third pivotable clamping block; said third pivotably clamping block having a rope passage therethrough in intersecting relation with the pivot axis of said pivotable block; and a rope extending downwardly through the housing so that it passes through the central grip zone formed by the rotary clamping blocks and through the passage in the pivotable clamping block; said connector means being oriented to the attached clamping blocks so that manual movement of the hand grips from their first positions to their second positions causes the rope passage to be shifted from a first vertical orientation toward a second orientation extending generally transverse to the central vertical axis of the associated pivotable block.

2. The controller of claim 1, and further comprising a fourth pivotable clamping block mounted with its pivot axis of the housing; a second connector means (6) interconnecting the other rotary clamping block to the fourth pivotable clamping block so that rotation of said other rotary clamping block by the associated hand grip produces a pivotal motion of the fourth pivotable clamping block; said fourth pivotable clamping block having a second rope passage therethrough in intersecting relation to the block pivot axis; said second connector means being oriented to the attached clamping blocks so that manual movement of the hand grips from their first positions to their second positions causes the second rope passage to be shifted from a first vertical orientation to a second orientation extending generally transverse to the central vertical axis of the associated pivotable block; one of said pivotable clamping blocks being located in a central space above the rotary clamping blocks; the other pivotable clamping block being located in a central space below the rotary clamping blocks.

3. The controller of claim 2 wherein each said connecting means is a connecting rod having opposite end portions thereof pivotably attached to the associated clamping blocks.

* * * * *